US012276121B2

(12) United States Patent
Richardet

(10) Patent No.: US 12,276,121 B2
(45) Date of Patent: Apr. 15, 2025

(54) ADJUSTABLE SCREED BOARD

(71) Applicant: Will Joseph Richardet, Perryville, MO (US)

(72) Inventor: Will Joseph Richardet, Perryville, MO (US)

( * ) Notice: Subject to any disclaimer, the term of this patent is extended or adjusted under 35 U.S.C. 154(b) by 571 days.

(21) Appl. No.: 17/718,621

(22) Filed: Apr. 12, 2022

(65) Prior Publication Data

US 2022/0325535 A1 Oct. 13, 2022

Related U.S. Application Data

(60) Provisional application No. 63/173,753, filed on Apr. 12, 2021.

(51) Int. Cl.
*E04F 21/24* (2006.01)

(52) U.S. Cl.
CPC ..... *E04F 21/241* (2013.01)

(58) Field of Classification Search
CPC ..... E04F 21/241
USPC ..... 404/118; 15/235.8
See application file for complete search history.

(56) References Cited

U.S. PATENT DOCUMENTS 5,468,095 A * 11/1995 Dawson ..... B28B 1/29 404/118
5,671,553 A * 9/1997 Burkhart ..... E01C 19/15 37/285
6,053,659 A * 4/2000 Burton ..... E01C 19/187 404/97
6,412,185 B1 * 7/2002 Mills ..... E04F 21/20 52/749.11
7,028,366 B2 * 4/2006 Brozoska ..... E04F 21/162 15/236.08
7,192,216 B2 * 3/2007 Casale ..... E04F 21/04 404/101
7,470,083 B2 * 12/2008 Black ..... E04G 21/10 404/96
9,719,266 B2 * 8/2017 Lopez ..... E04F 21/244
10,799,907 B1 * 10/2020 Daranuta ..... E04F 21/162
2007/0061989 A1 * 3/2007 Kalbach ..... E04F 21/241 15/235.4

FOREIGN PATENT DOCUMENTS

FR 2898372 A1 9/2006
GB 2371583 A * 7/2002 ..... E04F 21/241

* cited by examiner

*Primary Examiner* — Gary S Hartmann
(74) *Attorney, Agent, or Firm* — Polsinelli PC

(57) ABSTRACT

An adjustable screed board includes an outer member elongated along a longitudinal axis of the adjustable screed board. The outer member includes a leveling surface. The adjustable screed board also includes an inner member elongated along the longitudinal axis and coupled to the outer member for sliding movement, relative to the outer member, along the longitudinal axis. The inner member includes a leveling surface configured to remain flush with the leveling surface of the outer member during relative sliding movement of the inner and outer members. The leveling surfaces of the inner and outer members are oriented to cooperatively define a bottommost edge of the adjustable screed board along a working length.

20 Claims, 3 Drawing Sheets

ADJUSTABLE SCREED BOARD

CROSS REFERENCE TO RELATED APPLICATIONS

This application claims the benefit of, and priority to, U.S. Provisional Application Ser. No. 63/173,753 filed Apr. 12, 2021, entitled "ADJUSTABLE SCREED BOARD," the entire contents of which are hereby incorporated by reference.

FIELD

The field of the disclosure relates generally to installing indoor or outdoor flooring and, more particularly, to an adjustable screed board for smoothing and truing viscous material to form an underlayment for a floor.

BACKGROUND

Some known types of flooring, such as tile, function best when installed over a smooth and accurately graded substrate. Many known flooring substrates are formed by pouring and spreading a wet, viscous material (e.g., formed from sand, water, and cement often referred to as "mud") over the area to be floored, and then smoothing and truing an upper surface of the viscous material. The viscous material then cures to form an underlayment, and the tile or other outer flooring material is laid over the smoothed and trued upper surface of the underlayment.

A screed board or other tool may be used to smooth and true the upper surface of the viscous material. Typical screed boards are simple flattened rectangular sections of aluminum or wood that may be dragged across the upper surface of the viscous material. In at least some cases, to achieve a consistent grade and smoothness across the upper surface, a length of the screed board is selected to be as long as possible (without becoming too long for manual handling) while still allowing movement within the constraints of the project. For example, a shorter screed board may be required for the underlayment of tile in a bathroom, to avoid interference with the walls of the room, while a longer screed board may be required to maintain upper surface consistency across a wide outdoor underlayment. As a result, the typical artisan may be required to purchase and maintain five to seven screed boards of different lengths.

In addition, in many cases, it is desired for the tile or other outer flooring material to be flush with one or more reference surfaces, such as an adjoining floored area, sidewalk, or edge of a swimming pool, or a drain cover positioned within the area to be floored. To account for a thickness of the tile or other outer flooring material, the upper surface of the underlayment must be offset from the reference surface. Known screed boards require the user to first take additional steps to mark the required offset in the environment, such as by separately measuring and marking a reference point for a height of the upper surface of the underlayment relative to the reference surface, and then to manually track adherence to the reference point while simultaneously smoothing and grading with the screed board. This increases a time and effort required for installing the smooth and accurately graded underlayment.

Some known screed boards have incorporated adjustability features in an attempt to meet these needs. Such known adjustable screed boards typically include two or more elongated members configured to slide relative to one another along adjoining flat surfaces. However, such known adjustable screed boards lack stability when extended, and the interface locations of the members define relatively deep corners that tend to accumulate large quantities of the viscous material.

Accordingly, an adjustable screed board that is usable under multiple length requirements, and/or that facilitates adherence to a reference surface during use, while exhibiting improved stability and/or requiring fewer moving components, would find utility.

SUMMARY

In one aspect, an adjustable screed board is provided. The adjustable screed board includes an outer member elongated along a longitudinal axis of the adjustable screed board. The outer member includes a leveling surface. The adjustable screed board also includes an inner member elongated along the longitudinal axis and coupled to the outer member for sliding movement, relative to the outer member, along the longitudinal axis. The inner member includes a leveling surface configured to remain flush with the leveling surface of the outer member during relative sliding movement of the inner and outer members. The leveling surfaces of the inner and outer members are oriented to cooperatively define a bottommost edge of the adjustable screed board along a working length.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
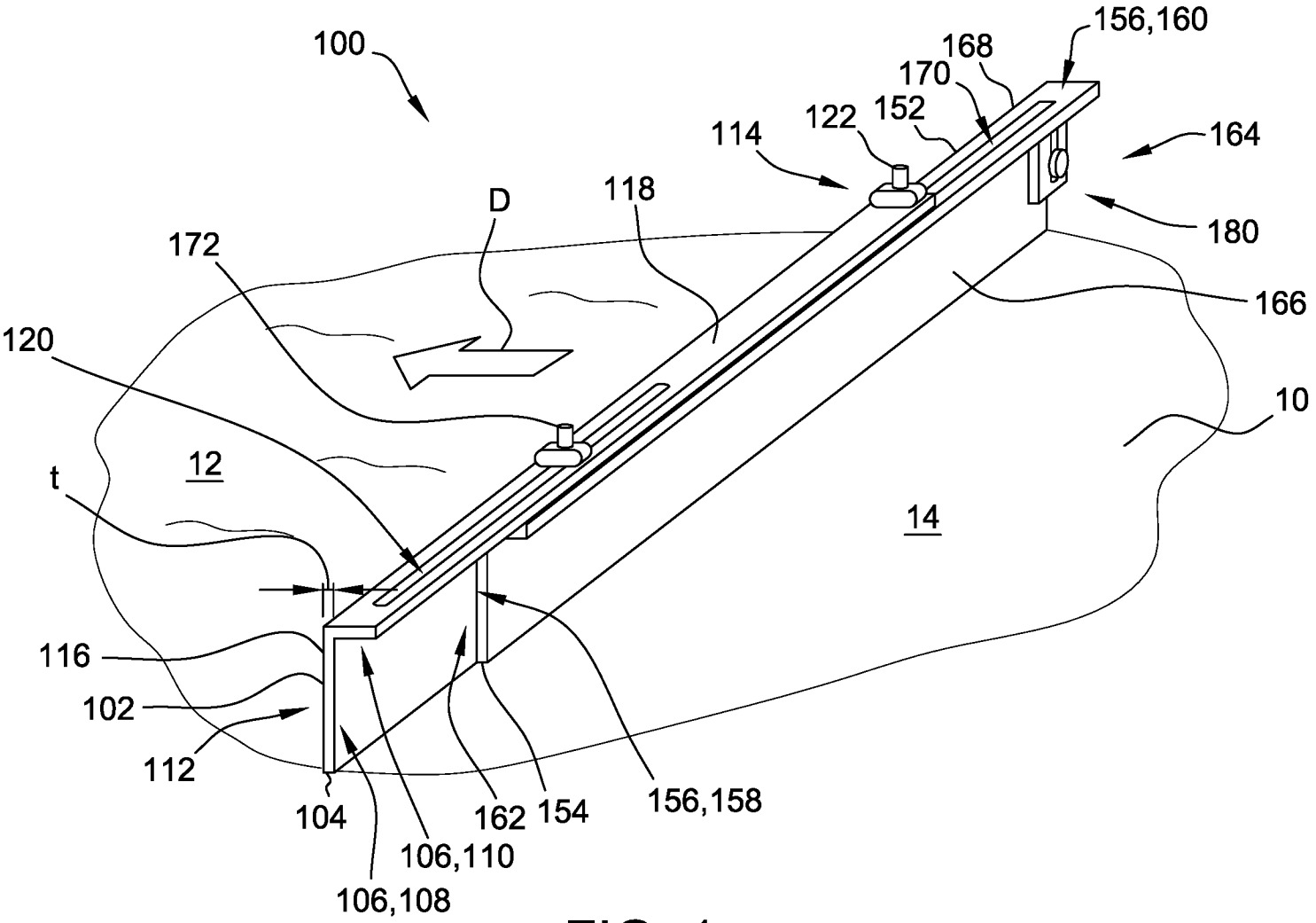
FIG. 1 is a perspective view of an example embodiment of an adjustable screed board.
Figure 2:
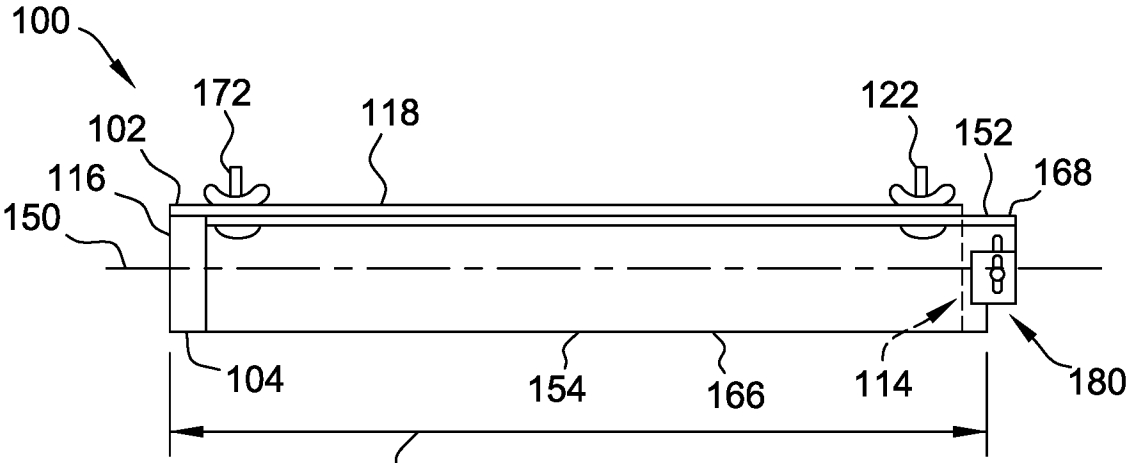
FIG. 2 is a side elevation view of the adjustable screed board of FIG. 1 in a fully retracted position.
Figure 3:
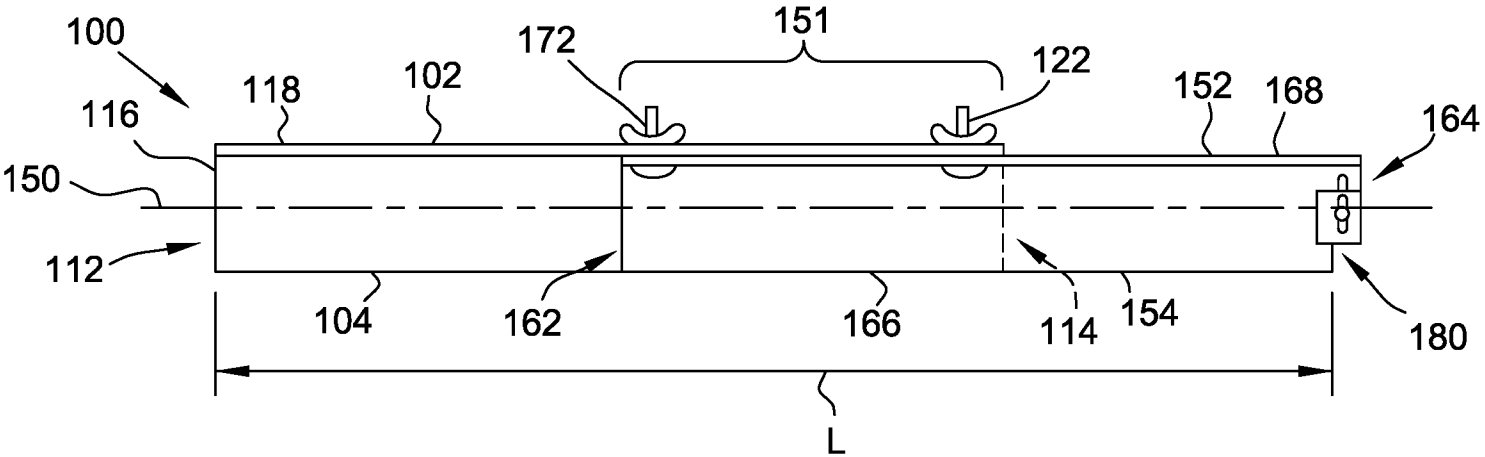
FIG. 3 is a side elevation view of the adjustable screed board of FIG. 1 in a fully extended position.

FIG. 1 is a perspective view of an example embodiment of an adjustable screed board 100. FIG. 2 is a side elevation view of adjustable screed board 100 in a fully retracted position, and FIG. 3 is a side elevation view of adjustable screed board 100 in a fully extended position.

Adjustable screed board 100 includes an outer member 102 and an inner member 152 that each are elongated along a longitudinal axis 150 of adjustable screed board 100. More specifically, outer member 102 extends longitudinally from a first edge 112 to an opposite second edge 114, and inner member 152 extends longitudinally from a first edge 162 to an opposite second edge 164. In the fully retracted position, first edge 112 of outer member 102 is adjacent to first edge 162 of inner member 152, and second edge 114 of outer member 102 is adjacent to second edge 164 of inner member 152.

Inner member 152 is slidably coupled to outer member 102. More specifically, inner member 152 is constrained to slide bi-directionally relative to outer member 102 along longitudinal axis 150. Accordingly, as best seen in FIGS. 2 and 3, a working length L of adjustable screed board 100 is adjustable by sliding inner member 152 relative to outer member 102 along longitudinal axis 150.

Outer member 102 includes a leveling surface 104, and inner member 152 likewise includes a leveling surface 154 configured to remain flush with leveling surface 104 as outer member 102 and inner member 152 are adjusted along longitudinal axis 150. Leveling surface 104 and leveling surface 154 are oriented to cooperatively define a bottom-most edge of adjustable screed board 100 along working length L during use. More specifically, as adjustable screed board 100 is moved in a working direction D along a top portion 12 of a viscous material 10, leveling surface 104 and leveling surface 154 are oriented to smooth top portion 12 to define a graded surface 14 atop viscous material 10.

In some embodiments, an outer surface 156 of inner member 152 is non-linear and is shaped to conform to an inner surface 106 of outer member 102. Moreover, outer surface 156 and inner surface 106 abut each other in an overlap region 151, which varies in length as working length L is adjusted. As length L of adjustable screed board 100 is adjusted towards the fully extended position shown in FIG. 3, in which overlap region 151 has its shortest length, the abutment of non-linear conforming outer surface 156 and inner surface 106 provides improved stability to adjustable screed board 100, relative to conventional adjustable screed boards that have only a single flat (linear) abutment between adjustable members. For example, the abutment of non-linear conforming outer surface 156 and inner surface 106 reduces a freedom of outer member 102 and inner member 152 to bend and twist relative to each other as adjustable screed board 100 is pulled along top portion 12 of viscous material 10.

In the illustrated embodiment, the conforming non-linear shape of outer surface 156 and inner surface 106 is L-shaped. More specifically, outer surface 156 includes a vertical planar portion 158 and an orthogonal horizontal planar portion 160, and inner surface 106 includes a vertical planar portion 108 and an orthogonal horizontal planar portion 110. Within overlap region 151, vertical planar portion 158 is oriented in a face-to-face relationship with vertical planar portion 108, and horizontal planar portion 160 is oriented in a face-to-face relationship with horizontal planar portion 110. Alternatively, the conforming non-linear shape of outer surface 156 and inner surface 106 is defined in any suitable fashion that enables adjustable screed board 100 to function as described herein.

In some embodiments, outer member 102 includes a vertical leg 116 and a horizontal leg 118, and inner member 152 likewise includes a vertical leg 166 and a horizontal leg 168. For example, vertical leg 116 defines vertical planar portion 108 of inner surface 106, horizontal leg 118 defines horizontal planar portion 110 of inner surface 106, vertical leg 166 defines vertical planar portion 158 of outer surface 156, and horizontal leg 168 defines horizontal planar portion 160 of outer surface 156. In some such embodiments, horizontal legs 118, 168 cooperate to provide convenient hand grips for a user of adjustable screed board 100. Alternatively, each of outer member 102 and inner member 152 has any suitable configuration that enables adjustable screed board 100 to function as described herein Moreover, in certain embodiments, outer member 102 and inner member 152 are each formed, in an advantageously simple process, from aluminum sheet cut to size and bent into the conforming L-shapes described above. Alternatively, each of outer member 102 and inner member 152 are formed in any suitable fashion that enables adjustable screed board 100 to function as described herein.

Additionally or alternatively, in some embodiments, a thickness t of each of vertical legs 116, 166 does not exceed 0.125 inches. This limitation on thickness t correspondingly limits a depth of the "corner" formed by vertical first edge 162 of inner member 152 projecting forward from inner surface 106 of outer member 102 at an end of overlap region 150, thereby advantageously decreasing an amount of viscous material 10 that can accumulate along vertical first edge 162. Alternatively, each of vertical legs 116, 166 has any suitable thickness that enables adjustable screed board 100 to function as described herein.

In some embodiments, relative movement between outer member 102 and inner member 152 is constrained to lie along longitudinal axis 150 via longitudinally oriented slots 120, 170 defined respectively through outer member 102 and inner member 152, and cooperating pin members 122, 172. More specifically, a position of pin member 122 is fixed on outer member 102 and pin member 122 extends through slot 170, enabling inner member 152 to slide along longitudinal axis 150 to an extent that pin member 122 can slide between opposing ends of slot 170. Similarly, a position of pin member 172 is fixed relative to inner member 152 and pin member 172 extends through slot 120, enabling outer member 102 to slide along longitudinal axis 150 to an extent that pin member 172 can slide between opposing ends of slot 120. Alternatively, relative movement between outer member 102 and inner member 152 is constrained to lie along longitudinal axis 150 in any suitable fashion that enables adjustable screed board 100 to function as described herein.

In the example embodiment, pin member 122 is implemented by a bolt extending in a clearance fit through a through-hole defined in outer member 102, and pin member 172 is implemented by a bolt extending in a clearance fit through a through-hole defined in inner member 152. The bolts are secured by respective nuts that may be tightened to secure outer member 102 relative to inner member 152, and loosened slightly to enable re-positioning of inner member 152 along longitudinal axis 150 relative to outer member 102. Alternatively, pin members 122, 172 are implemented in any suitable fashion that enables adjustable screed board 100 to function as described herein.

In certain embodiments, slot 120 is defined in horizontal leg 118 of outer member 102, and slot 170 is defined in horizontal leg 168 of inner member 152. Pin members 122, 172 are correspondingly mounted to horizontal leg 118 of outer member 102 and horizontal leg 168 of inner member 152. In some such embodiments, positioning of slots 120, 170 on respective horizontal legs 118, 168 improves a stability of adjustable screed board 100, as compared to locating slots 120, 170 on vertical legs 116, 166, which would necessitate removal of material from vertical legs 116, 166 and consequent loss of rigidity. Additionally or alternatively, positioning of slots 120, 170 on respective horizontal legs 118, 168, as compared to locating slots 120, 170 on vertical legs 116, 166, advantageously reduces or eliminates an ability for viscous material 10 to splash through slots 120, 170 or clog edges of slots 120, 170. Alternatively, slots 120, 170 are located in any suitable position on outer member 102 and inner member 152, respectively, that enables adjustable screed board 100 to function as described herein.

A location of slots 120, 170 and cooperating pin members 122, 172 defines limits of extension of inner member 152 relative to outer member 102. In the example embodiment, slot 120 extends from proximate a first edge 112 of outer member 102 and along no more than fifty percent of a longitudinal length of outer member 102, and pin member 172 is fixed relative to said inner member adjacent to first edge 162 of inner member 152. Likewise, slot 170 extends from proximate an opposite second edge 164 of inner member 152 and along no more than fifty percent of a longitudinal length of inner member 152, and pin member 122 is fixed relative to said outer member adjacent to a second edge 114 of outer member 102, opposite first edge 112 of outer member 102.

In the example embodiment, in the fully retracted position, overlap region 151 extends over slightly less than a full longitudinal length of outer member 102 and inner member 152. In some embodiments, the absence of complete overlap in the fully retracted position prevents interference with embodiments of a reference height adjustment mechanism 180 at one end of adjustable screed board 100, as described below. Alternatively, overlap region 151 in the fully retracted position has any suitable extent that enables adjustable screed board 100 to function as described herein. Moreover, in the fully extended position, overlap region 151 extends over no more than half a longitudinal length of each of outer member 102 and inner member 152. In certain embodiments, limiting overlap region 151 to about half a longitudinal length of each of outer member 102 and inner member 152 improves a stability of adjustable screed board 100 at full extension, by maintaining a sufficiently large interface area between inner surface 106 and outer surface 156 to inhibit twisting or bowing of extended regions of outer member 102 and inner member 152. Alternatively, overlap region 151 has any suitable extent in the fully extended position that enables adjustable screed board 100 to function as described herein.

Figure 4:
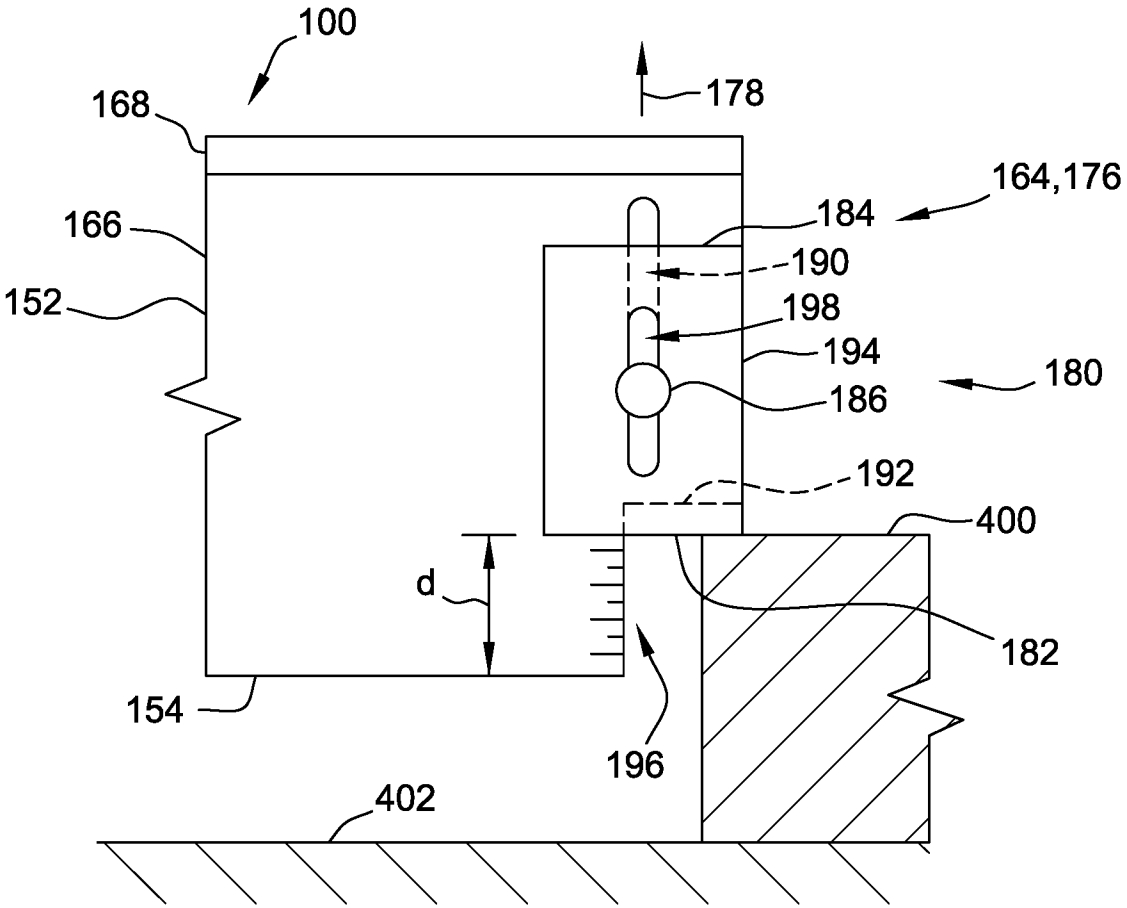
FIG. 4 is a detail view of the adjustable screed board of FIG. 1, illustrating an example embodiment of a reference height adjustment mechanism.

FIG. 4 is a detail view of adjustable screed board 100, illustrating an example embodiment of a reference height adjustment mechanism 180. Reference height adjustment mechanism 180 is coupled at reference edge 176 of adjustable screed board 100. Reference edge 176 is one of second edge 164 of inner member 152 and first edge 112 of outer member 102, as described further below.

Reference height adjustment mechanism 180 is adjustable to apply a selected vertical offset distance d between a base surface 182, oriented to abut a reference surface 400, and leveling surfaces 104 and 154 during use of adjustable screed board 100. Base surface 182 is oriented parallel to leveling surfaces 104 and 154.

For example, reference surface 400 is defined by an upper surface of a floored area, sidewalk, or edge of a swimming pool adjoining an unfinished area 402 to be floored, or a drain cover positioned within the unfinished area 402 to be floored. To ensure that a top surface of a tile or other outer flooring material (not shown) intended to be laid atop graded surface 14 (shown in FIG. 1) will be flush with reference surface 400, a user adjusts reference height adjustment mechanism 180 such that offset distance d is equal to a thickness of the tile or other outer flooring material. Accordingly, when base surface 182 of reference height adjustment mechanism 180 is positioned to abut reference surface 400 at reference edge 176, cooperating leveling surfaces 104, 154 applied to top portion 12 of viscous material 10 (shown in FIG. 1) define graded surface 14 at offset distance d below reference surface 400.

In the illustrated embodiment, reference edge 176 is implemented at second edge 164 of inner member 152. Accordingly, the description below is made primarily with respect to reference edge 176 being implemented on inner member 152, with additional description in parentheses to address embodiments in which reference edge 176 is alternatively implemented at first edge 112 of outer member 102. It should be noted that reference height adjustment mechanism 180 is functional as implemented at a single reference edge 176, and is not required to be implemented at both second edge 164 of inner member 152 and first edge 112 of outer member 102.

In the example embodiment, reference height adjustment mechanism 180 includes a block 184 slidably coupled to adjustable screed board 100 at reference edge 176, i.e., coupled to inner member 152 at second edge 164 of inner member 152 in the illustrated embodiment (or, alternatively, coupled to outer member 102 at first edge 112 of outer member 102). More specifically, block 184 is constrained to slide bi-directionally relative to inner member 152 (or, alternatively, outer member 102) along a vertical axis 178. Block 184 defines base surface 182 along a lower edge of block 184. Alternatively, base surface 182 is defined in any suitable fashion that enables reference height adjustment mechanism 180 to function as described herein.

In some embodiments, relative movement between block 184 and inner member 152 (or alternatively, outer member 102) is constrained to lie along vertical axis 178 via a vertically oriented reference slot 188 defined through one of block 184 and, in the illustrated embodiment, inner member 152 (or alternatively outer member 102, in embodiments in which reference edge 176 is implemented on outer member 102). A cooperating pin member 186 extends through reference slot 188 and the other of block 184 and inner member 152 (or alternatively outer member 102). More specifically, pin member 186 extends through reference slot 188, enabling block 184 to slide along vertical axis 178 to an extent that pin member 186 can slide between opposing ends of reference slot 188.

In some embodiments, pin member 186 is implemented by a bolt secured by a nut that may be tightened to affix block 184 relative to inner member 152 (or alternatively relative to outer member 102), and loosened slightly to enable re-positioning of block 184 along vertical axis 178 relative to inner member 152 (or alternatively relative to outer member 102). Alternatively, pin member 186 is implemented in any suitable fashion that enables adjustable screed board 100 to function as described herein.

Further in some embodiments, an additional slot 190 is defined through the other of block 184 and inner member 152 (or outer member 102) and oriented parallel to reference slot 188. Pin member 186 extends through the other of block 184 and inner member 152 (or outer member 102) via the additional slot 190. In some implementations, an additional pin member (not shown) may be inserted through slots 188 and 190 to further stabilize a rotational orientation of block 184 relative to inner member 152 (or relative to outer member 102). Alternatively, the additional pin member and/or the additional slot 190 are not included.

In some embodiments, reference slot 188 is defined through block 184 and the additional slot 190, if implemented, is defined through inner member 152 (or, alternatively, through outer member 102). If the additional slot 190 is not implemented, pin member 186 may extend, for example, in a clearance fit through a through-hole defined in inner member 152 (or, alternatively, defined in outer member 102) at a location adjacent to reference edge 176.

In other embodiments, rather than being defined through block 184, reference slot 188 is defined through inner member 152 (or, alternatively, through outer member 102) at a location adjacent to reference edge 176. In such embodiments, the additional slot 190, if implemented, is defined through block 184. If the additional slot 190 is not implemented, pin member 186 may extend in a clearance fit through a through-hole defined in block 184, for example.

Alternatively, relative movement between block 184 and inner member 152 (or alternatively, between block 184 and outer member 102) is constrained to lie along vertical axis 178 in any suitable fashion that enables adjustable screed board 100 to function as described herein.

In some embodiments, a side edge 194 of block 184 is aligned with reference edge 176. Side edge 194 being aligned with reference edge 176 causes block 184 to lie completely within a planar profile of inner member 152 (or, alternatively, within a planar profile of outer member 102), which facilitates storage of adjustable screed board 100 and safety in handling adjustable screed board 100. In some embodiments, block 184 positioned completely within the planar profile of inner member 152 (or, alternatively, the planar profile of outer member 102) reduces a size of, and storage space required for, adjustable screed board 100.

Furthermore, in some such embodiments, reference edge 176 includes a cut-out portion 192 extending transverse to vertical axis 178. For example, cut-out portion 192 facilitates avoiding interference between leveling surface 154 of inner member 152 (or, alternatively, leveling surface 104 of outer member 102) and reference surface 400 when offset distance d is non-zero. Alternatively, avoidance of interference between leveling surface 154 (or, alternatively, leveling surface 104) and reference surface 400 is facilitated in any suitable fashion that enables adjustable screed board 100 to function as described herein.

In other embodiments, block 184 is coupled at reference edge 176 such that side edge 194 (and, thus, a portion of base surface 182) extends beyond reference edge 176, enabling base surface 182 to rest against reference surface 400 without interference from leveling surface 154 (or alternatively, from leveling surface 104). In some such embodiments, reference edge 176 does not include cut-out portion 192.

Alternatively, block 184 is coupled at reference edge 176 in any suitable position and/or orientation that enables adjustable screed board 100 to function as described herein.

In some embodiments, reference edge 176 includes scale markings 196 defined thereon. More specifically, scale markings 196 increment, for example in fractions of an inch or centimeters, upwards from leveling surface 154 (or alternatively from leveling surface 104) along reference edge 176 and assist a user in positioning base surface 182 at precisely the desired offset distance d. Alternatively, reference edge 176 does not include scale markings.

In some embodiments, reference height adjustment mechanism 180 assists a user in adjusting and maintaining a desired offset distance d of graded surface 14 from reference surface 400, while providing a convenient and fast adjustment mechanism that requires few moving parts and does not significantly increase a size of adjustable screed board 100 in the fully retracted position.

Examples of an adjustable screed board are described above in detail. The apparatus is not limited to the specific examples described herein, but rather, components of the apparatus may be used independently and separately from other components and environmental elements described herein. For example, the apparatus described herein may be used in a variety of environments, including and without limitation, indoors and outdoors, and with any category of underlayment having a viscous nature suitable for grading by the apparatus.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. An adjustable screed board comprising:

an outer member elongated along a longitudinal axis of said adjustable screed board, said outer member comprising a leveling surface; and an inner member elongated along the longitudinal axis and coupled to said outer member for sliding movement, relative to said outer member, along the longitudinal axis, said inner member comprising a leveling surface configured to remain flush with said leveling surface of said outer member during relative sliding movement of said inner and outer members, wherein said leveling surfaces of said inner and outer members are oriented to cooperatively define a bottommost edge of said adjustable screed board along a working length, wherein said inner and outer members each comprise:

a first leg extending vertically from said leveling surface to a top end;

a second leg coupled to said top end and extending horizontally therefrom;

a pin member coupled in a fixed position to said second leg; and a slot defined in said second leg, wherein said pin member of said inner member extends through said slot of said outer member and said pin member of said outer member extends through said slot of said inner member.

2. The adjustable screed board according to claim 1, wherein:

said first and second legs of said inner member define an outer surface that is non-linear; and said first and second legs of said outer member define an inner surface shaped to conform to said outer surface.

3. The adjustable screed board according to claim 2, wherein said outer surface and said inner surface abut each other in an overlap region, said overlap region varies in length as said working length is adjusted.

4. The adjustable screed board according to claim 3, wherein a conforming non-linear shape of said outer surface and said inner surface is L-shaped.

5. The adjustable screed board according to claim 4, wherein within the overlap region, said first leg of said inner member and said first leg of said inner member are oriented in a first face-to-face relationship, and said second leg of said inner member and said second leg of said inner member are oriented in a second face-to-face relationship.

6. The adjustable screed board according to claim 5, wherein a thickness of each of said first legs of said outer and inner members does not exceed 0.125 inches.

7. The adjustable screed board according to claim 1, wherein:

said pin member of said outer member extends in a clearance fit through a through-hole defined in said outer member, and said pin member of said inner member extends in a clearance fit through a through-hole defined in said inner member.

8. The adjustable screed board according to claim 1, wherein:

said outer member extends from a first edge to an opposite second edge, said slot of said outer member extends from proximate said first edge of said outer member and along no more than half a longitudinal length of outer member;

said inner member extends from a first edge to an opposite second edge, said slot of said inner member extends from proximate said second edge of said inner member and along no more than half a longitudinal length of inner member;

said pin member of said outer member is fixed adjacent to said second edge of said outer member; and said pin member of said inner member is fixed adjacent to said first edge of said inner member.

9. The adjustable screed board according to claim 1, further comprising:

a reference edge; and a reference height adjustment mechanism coupled at said reference edge, said reference height adjustment mechanism comprising a base surface oriented parallel to said cooperating leveling surfaces, wherein said reference height adjustment mechanism is adjustable to apply a selected vertical offset distance between said base surface and said cooperating leveling surfaces.

10. The adjustable screed board according to claim 9, wherein said outer member extends longitudinally from a first edge to an opposite second edge, said inner member extends longitudinally from a first edge to an opposite second edge, and said reference edge of said adjustable screed board is defined as one of said second edge of said inner member and said first edge of said outer member.

11. The adjustable screed board according to claim 9, wherein said reference height adjustment mechanism comprises a block slidably coupled to said adjustable screed board at said reference edge for movement along a vertical axis.

12. The adjustable screed board according to claim 11, wherein said block comprises a lower edge that defines said base surface.

13. The adjustable screed board according to claim 11, wherein said reference height adjustment mechanism further comprises:

a reference slot defined through said block and vertically oriented; and a reference pin member extending through said reference slot.

14. The adjustable screed board according to claim 13, wherein said reference height adjustment mechanism further comprises:

an additional slot defined through one of said inner member and said outer member, said additional slot oriented parallel to said reference slot, wherein said reference pin member extends through said additional slot.

15. The adjustable screed board according to claim 11, wherein said reference height adjustment mechanism further comprises:

a reference slot defined through one of said inner member and said outer member, wherein said reference slot is vertically oriented; and a reference pin member extending through said reference slot and through said block.

16. The adjustable screed board according to claim 15, wherein said reference height adjustment mechanism further comprises:

an additional slot defined through said block, said additional slot oriented parallel to said reference slot, wherein said reference pin member extends through said additional slot.

17. The adjustable screed board according to claim 11, wherein said block further comprises a side edge aligned with said reference edge.

18. The adjustable screed board according to claim 17, wherein said reference edge includes a cut-out portion extending transverse to the vertical axis.

19. The adjustable screed board according to claim 18, wherein said reference edge reference edge includes scale markings defined thereon below said cut-out portion.

20. An adjustable screed board comprising:

an outer member elongated along a longitudinal axis of said adjustable screed board and extending from a first edge to an opposite second edge, said outer member comprising:

a slot defined therethrough and oriented longitudinally, said slot of said outer member extends from proximate said first edge of said outer member and along no more than half a longitudinal length of outer member; and a leveling surface;

an inner member elongated along the longitudinal axis and extending from a first edge to an opposite second edge, said inner member coupled to said outer member for sliding movement, relative to said outer member, along the longitudinal axis, said inner member comprising:

a slot defined therethrough and oriented longitudinally, said slot of said inner member extends from proximate said second edge of said inner member and along no more than half a longitudinal length of inner member; and a leveling surface configured to remain flush with said leveling surface of said outer member during relative sliding movement of said inner and outer members, wherein said leveling surfaces of said inner and outer members are oriented to cooperatively define a bottommost edge of said adjustable screed board along a working length;

a first pin member in a fixed position on said outer member adjacent to said second edge of said outer member, wherein said first pin member extends through said slot of said inner member; and a second pin member in a fixed position on said inner member adjacent to said first edge of said inner member, wherein said second pin member extends through said slot of said outer member.

* * * * *